US007697705B2

(12) United States Patent
Killion et al.

(10) Patent No.: US 7,697,705 B2
(45) Date of Patent: Apr. 13, 2010

(54) HIGH FIDELITY DIGITAL HEARING AID AND METHODS OF PROGRAMMING AND OPERATING SAME

(75) Inventors: Mead C. Killion, Elk Grove Village, IL (US); John S. French, Arlington, IL (US); Steven Viranyi, Palatine, IL (US); Timothy Monroe, Schaumburg, IL (US); David Preves, Chanhassen, MN (US); Norman Matzen, Campbell, CA (US); Gail Gudmundsen, Elk Grove Village, IL (US)

(73) Assignee: Etymotic Research, Inc., Elk Grove Village, IL (US)

( * ) Notice: Subject to any disclaimer, the term of this patent is extended or adjusted under 35 U.S.C. 154(b) by 1115 days.

(21) Appl. No.: 10/271,266

(22) Filed: Oct. 15, 2002

(65) Prior Publication Data

US 2003/0086581 A1 May 8, 2003

Related U.S. Application Data

(60) Provisional application No. 60/328,918, filed on Oct. 12, 2001.

(51) Int. Cl.
*H04R 25/00* (2006.01)

(52) U.S. Cl. ..... 381/316; 381/312

(58) Field of Classification Search ..... 381/312, 381/320

See application file for complete search history.

(56) References Cited

U.S. PATENT DOCUMENTS

| | | | | |
|---|---|---|---|---|
| 5,987,146 | A | 11/1999 | Pluvinage et al. | 381/328 |
| 6,028,944 | A | 2/2000 | Markow et al. | 381/120 |
| 6,047,075 | A * | 4/2000 | Killion et al. | 381/312 |
| 6,449,662 | B1 * | 9/2002 | Armitage | 710/8 |
| 6,937,738 | B2 * | 8/2005 | Armstrong et al. | 381/312 |

OTHER PUBLICATIONS

Sandlin, Robert E. Textbook of Hearing Aid Amplification Technical and Clinical Considerations, 2nd Edition. Singular Thomson Learning, Jan. 2000. pp. 128, 370, and 421-422.*

Storey et al. A self-consistent set of hearing aid correction figures. Australian Hearing Research & Development Annual Report 1998/1999. pp. 10-11.*

* cited by examiner

*Primary Examiner*—Walter F Briney, III
(74) *Attorney, Agent, or Firm*—McAndrews, Held & Malloy, Ltd.

(57) ABSTRACT

A programmable digital hearing aid circuit and method for operating and programming same are disclosed. The device provides a flexible means to compensate for undesirable frequency response distortion normally due to the electro-acoustical characteristics of the microphone, receiver, and sound coupling mechanisms employed in hearing aid design. Parameters of the programmable hearing aid circuit may also be set to tailor the hearing aid response characteristics for the frequency-dependent hearing loss of an individual hearing aid user. The device is intended to make available a significant improvement in audio fidelity to users of hearing aid devices.

20 Claims, 8 Drawing Sheets

HIGH FIDELITY DIGITAL HEARING AID AND METHODS OF PROGRAMMING AND OPERATING SAME

RELATED APPLICATIONS

"The applicants claim priority based on provisional application No. 60/328,918 filed Oct. 12, 2001, the complete subject matter of which is incorporated herein by reference in its entirety."

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

A practical problem has prevented the widespread use and availability of high fidelity hearing aids. Specifically, dampers, which are used to smooth the frequency response, often needed to be near the tip of the hearing aid outlet at a point where they are easily clogged with ear canal wax.

As a result, hearing aid manufacturers stopped using dampers near the eartip, and unpleasant peaks in the frequency response became commonplace. This problem was recognized by Killion et al. in U.S. Pat. No. 5,812,679 issued Sep. 22, 1998 entitled "Electronic Damper Circuit for a Hearing Aid and Method of Using the Same" and in U.S. Pat. No. 6,047,075 issued Apr. 4, 2000 entitled "Damper for Hearing Aid." These patents describe the use of electronic filtering to substitute for the acoustic damper. One of the realizations at the time was that by making the filter programmable, it could be adjusted to accommodate the different peak frequencies that are obtained when different lengths of tubing are used with the earphone to accommodate different lengths of ear canals and earmolds.

Although the electronic damping of Killion et al. was a substantial contribution, we now have realized additional problems in making a completely high fidelity hearing aid. Even though the response with different receiver "plumbing" arrangements can be adequately damped, the finished frequency response may not produce a full fidelity hearing aid. In other cases, the model of receiver that is chosen on the basis of power handling or other considerations, may have its peak frequency placed well below 2 kHz. In this situation, according to the prior art, a high fidelity response becomes nearly impossible, regardless of the choice of damping or plumbing.

To explain, a full fidelity hearing aid generally must have a frequency response matching one of the "CORFIG" responses described by Killion and Monser (CORFIG: Coupler Response for Flat Insertion Gain by Mead C. Killion and Edward L. Monser, IV, in *Acoustical Factors Affecting Hearing Aid Performance*, Studebaker, G. A. and Hochberg, I., eds., pgs. 149-168, 1980) (Appendix A) and by Killion and Revit (CORFIG and GIFROC: Real Ear to Coupler and Back by Mead C. Killion and Lawrence Revit in *Acoustical Factors Affecting Hearing Aid Performance* ($2^{nd}$ Ed.), Studebaker, G. A. and Hochberg, I., eds., pgs. 65-86, 1993). The adequately damped peak may, in a particular case, be at a different frequency than the approximately 2.5 kHz frequency of the open ear. In order to have a full fidelity frequency response, it may be necessary to replicate the response that would normally occur at the eardrum without a hearing aid in place. This response is described in the "CORFIG" curve for the type of hearing aid in question (behind-the-ear, in-the-ear, canal aid or completely-in-the-canal aid) as described in Appendix A and in Killion and Revit (mentioned above).

In addition, the microphone response often rolls off above 3 or 4 kHz, making it desirable to further equalize the microphone. This was recognized by Killion et al. in the early application notes for the "K-AMP" integrated circuit chip (as described in ER-101-28D Data Sheet dated 92/7/2) (Appendix B). Capacitor C2S, as described in Note 2 of Appendix B, provided a high frequency boost to compensate for the loss of high frequency response in typical microphones, just as capacitor CHFB produced a high frequency boost to compensate for the loss of high frequency output in typical receivers (Appendix B). A problem arises because microphones must sometimes be mounted at a distance behind the faceplate of the hearing aid and connected to the opening in the faceplate with a section of tubing. Different hearing aids in the same nominal family of hearing aids, therefore, may require different amounts of high frequency correction for the microphone and/or receiver.

Further limitations and disadvantages of conventional and traditional approaches will become apparent to one of skill in the art, through comparison of such systems with the present invention as set forth in the remainder of the present application with reference to the drawings.

BRIEF SUMMARY OF THE INVENTION

Aspects of the present invention are found in a hearing aid that has a microphone, a filter with a response curve defined to be one of the CORFIG response curves, and a receiver. The microphone converts the received sound energy into an electrical signal that is then sent to the filter. The filter modifies the electrical signal to achieve a hearing aid frequency response that corresponds to a CORFIG response curve, and the receiver converts the modified electrical signal back into sound.

In one embodiment, the response curve of the filter can be defined to include the high frequency boost needed to compensate for the high-frequency roll-off of the microphone response. In a further embodiment, the filter characteristics could include equalization to modify the response curve of a directional microphone into that of a non-directional microphone. In an additional embodiment, the hearing aid can be programmed to apply filtering to remove one or more peaks in the response curve of the microphone.

In yet another embodiment, the filter could be configured to apply a bandsplitting filter, a set of compression amplifiers, and a combiner, in order to compensate for the frequency-dependent hearing loss of the user. The bandsplitting filter segments the spectral content of the sound received by the microphone into a number of sub-bands. A separate compression amplifier processes each of those sub-bands, and the outputs of the compression amplifiers are then combined.

An embodiment of the present invention may also have the filter programmed in order to reduce one or more peaks in the response curve of the receiver. An additional embodiment could have the filter arranged to provide the high-frequency boost needed to compensate for the high-frequency roll-off of the receiver. An embodiment of the present invention may also allow the characteristics of the filter to be programmed after completion of manufacture of the hearing aid.

In another embodiment of the present invention, the electrical signal from the microphone is transformed into a digital representation by an analog-to-digital converter, and the filtering is performed using the digital representation. The result of the filtering operation is converted into a second electrical signal by a digital-to-analog converter.

An additional aspect of the present invention relates to a method of programming a digital hearing aid. The method illustrated includes the steps of equalizing one or more of the response characteristics of the microphone and receiver, removing at least one peak in the response curve of the microphone, removing at least one peak in the response curve of the receiver, and modifying the resulting frequency response characteristics of the digital hearing aid to correspond to the CORFIG response curve for the type of hearing aid being programmed. The method may also include programming the hearing aid frequency response curve to compensate for the frequency-dependent hearing loss of the hearing aid user.

Another aspect of the present invention relates to the operation of a digital hearing aid. A digital hearing aid operating according to one embodiment of the present invention converts received sound into an electrical signal, modifies the electrical signal in order to produce a CORFIG response for the particular type of hearing aid, converts the modified electrical signal into sound, and transmits the resulting sound into the ear canal of the hearing aid user.

In one embodiment, the present invention may operate so as to further modify the electrical signal to equalize the effects of the microphone and receiver. In a further embodiment, the operation of the digital hearing aid may effect a frequency response curve in order to compensate for the frequency-dependent hearing loss of the hearing aid user.

An additional embodiment of a method of operating a digital hearing aid comprises, for example, the steps of receiving sound from a sound field, generating a desired first frequency response, and subsequently modifying the first frequency response to achieve a desired second frequency response, in order that the desired second frequency response is perceived by the hearing aid user to be the desired first frequency response.

In one embodiment of a method of operating a digital hearing aid according to the present invention, the digital hearing aid generates a desired first frequency response that is an approximately flat frequency response. In still another embodiment of a method of operation, a digital hearing aid of a particular type modifies the desired first frequency response so that desired second frequency response is the CORFIG frequency response corresponding to the type of hearing aid being operated. Yet another embodiment of operation according to the present invention further modifies the desired first frequency response so that the desired second frequency response also compensates for the frequency-dependent hearing loss of the hearing aid user.

These and other advantages and novel features of the present invention, as well as details of an illustrated embodiment thereof will be more fully understood from the following description and drawings.

DETAILED DESCRIPTION OF THE INVENTION

One embodiment of the present invention comprises a method that uses seven "programmable bi-quad" filters in a particular digital hearing aid circuit. Two of the filters may provide, for example, peak damping as described in U.S. Pat. No. 5,812,679 and U.S. Pat. No. 6,047,075, which patents are hereby incorporated herein by reference in their entirety. These patents generally describe, for example, a shelving filter and a microphone compensation filter. Unlike the previous approach, however, in one embodiment of the present invention, filters (four, for example) are used to completely flatten the response of the hearing aid. Thus, it no longer matters if the peak frequency was at 2 kHz instead of at 2.5 kHz; the peak is completely flattened. Two additional filters, for example, are then used to reinsert the desired "CORFIG" frequency response shaping. The entire tuning process can be automated or is readily accomplished even without automatic computer selection of all of the filter characteristics, by watching an ongoing frequency response such as obtained from the Frye 6500 hearing aid test box "composite" signal, and adjusting it to a straight line on the computer screen. After that has been accomplished, the preprogrammed "CORFIG" equalization corresponding to the type of hearing aid being built is inserted. Alternately, the "CORFIG" responses can be built in the computer program, and the second step can be another flattening step resulting in a straight line on the computer screen where the proper hearing aid frequency response has the required "CORFIG" subtracted from it before presentation, meaning that a perfectly flat line would represent a hearing aid that had exactly the right "CORFIG" response.

Figure 1:
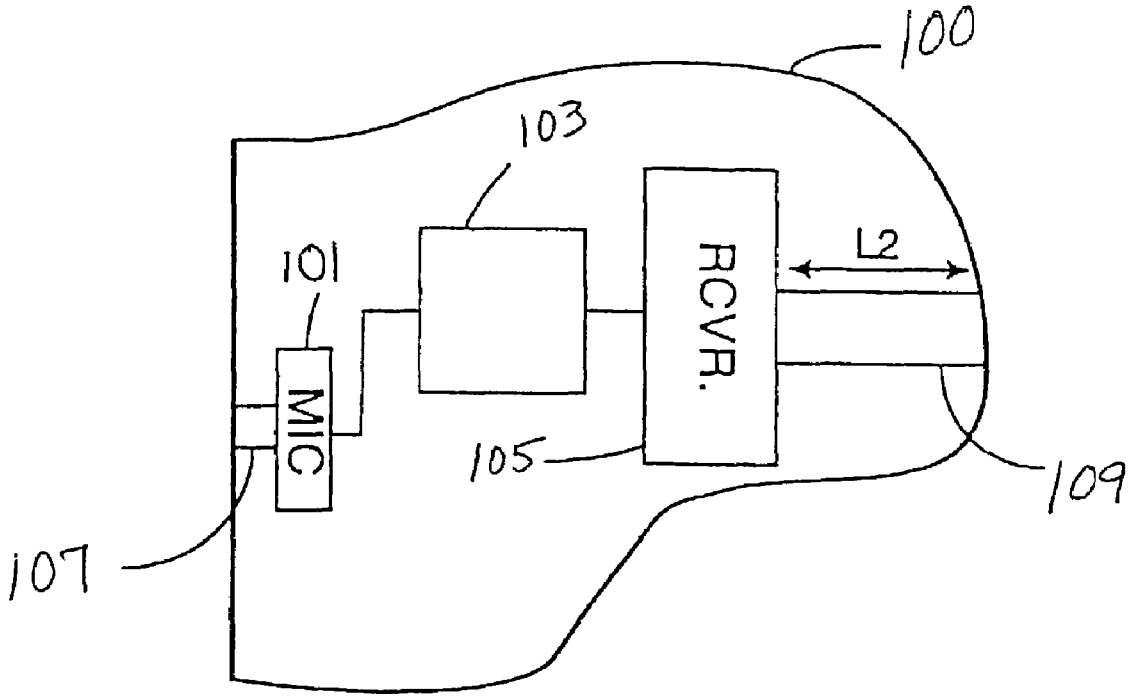
FIG. 1 shows a block diagram illustrating one embodiment of the present invention.

FIG. 1 shows one embodiment of a hearing aid in accordance with the present invention. Hearing aid 100 may be any type of hearing aid (e.g., BTE, ITE, ITC, or CIC.) Hearing aid 100 comprises a microphone 101, a programmable digital circuit 103, a receiver 105, an optional microphone sound tube 107 and an optional receiver sound tube 109. Sound is picked up from sound tube 107 by the microphone 101, and transduced into an electrical signal. The electrical signal is fed to programmable digital circuit 103, and the output of programmable digital circuit 103 is fed to the receiver 105. The receiver 105 transduces the signal back into sound, which is then is fed into the ear canal via an optional receiver sound tube 109.

Figure 2:
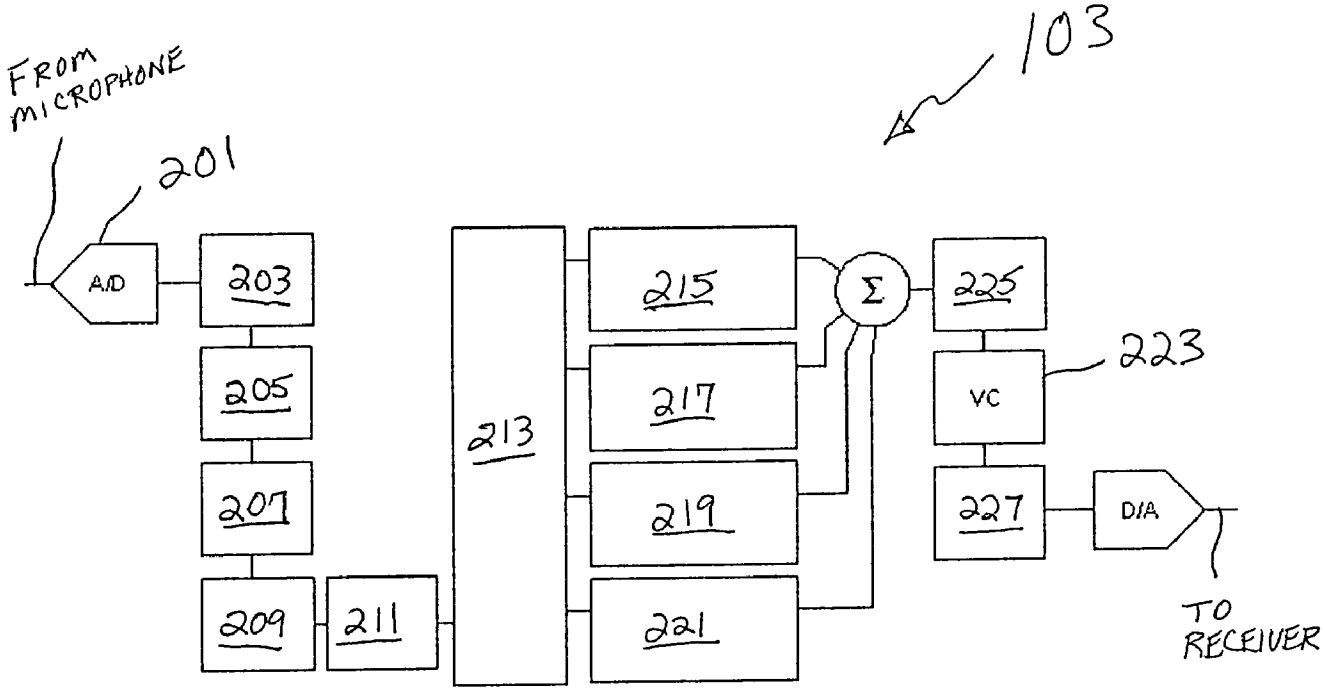
FIG. 2 shows a block diagram of the programmable digital circuit of FIG. 1, in accordance with one embodiment of the present invention.

FIG. 2 illustrates a block diagram of one embodiment of the programmable digital circuit 103 of FIG. 1. The output of the microphone (e.g., microphone 101 of FIG. 1) is fed to an analog to digital converter 201, the output of which is fed to filter 203, the first of five bi-quad filters. Filter 203 comprises, for example, a 20 Hz cut off frequency high pass filter for dc blocking and a 16 kHz boost. Filter 205 comprises, for example, a broad notch filter for damping a microphone response peak. Filter 207 (optional) inserts a low frequency gain boost to equalize a directional microphone response to a non-directional microphone response. Filter 209 comprises, for example, a broad notch filter for removing or damping a primary receiver response peak. Filter 211 likewise comprises a broad notch filter to remove or damp a second receiver response peak. The output of these filters is fed to a band-splitting filter 213, which operates in conjunction with programmable compressors 215, 217, 219 and 221. The programmable compression amplifiers 215, 217, 219 and 221 are programmed to act to compensate for the frequency-dependent hearing loss of the person to be fitted with the hearing aid. A volume control 223 operates in a normal manner to adjust the gain of the hearing aid.

In the embodiment of FIG. 2, two additional bi-quad filters follow the summation of the four compressor channels. Filter 225 inserts the desired frequency response peak according to the appropriate CORFIG curve, and filter 227 produces the desired high frequency response boost to compensate for the high frequency roll-off of the receiver. Filter 227 may include additional response compensation to assist in meeting the exact CORFIG curve depending on hearing aid model type (i.e., ITE, ITC, etc.).

A portion of FIG. 2, namely those filters that adjust for the response of the receiver, microphone, plumbing, etc. (e.g., filters 203, 205, 207, 209, 211, 225 and 227) may be programmed during the manufacturing process, and may be set so they are not modifiable by a hearing aid dispenser. In some cases, however, it may be desirable to allow a hearing aid dispenser to modify this portion to match the external acoustic characteristics of an individual ear (i.e., an individually measured CORFIG). Another portion of FIG. 2, namely splitting filter 213 and programmable compressors 215, 217, 219 and 221, may be programmed after manufacture by the hearing aid dispenser, depending on the characteristics of the hearing loss of a patient.

Figure 3:
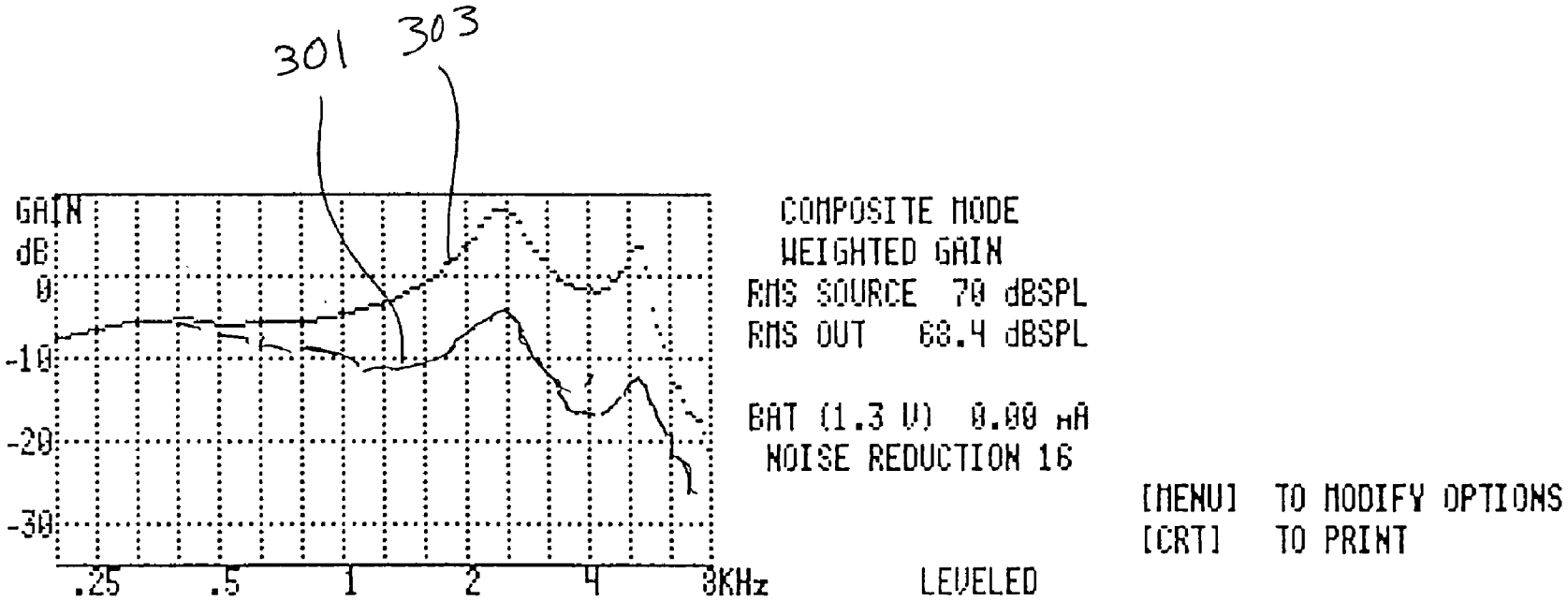
FIG. 3 illustrates an example of an uncorrected frequency response curve obtained with an undamped hearing aid, and a frequency response curve incorporating basic correction.

FIG. 3 illustrates two frequency responses obtained in an undamped hearing aid. Curve 301 shows the "as is" frequency response obtained without correction, and curve 303 shows the "as is" frequency response obtained using the digital hearing aid amplifier 103 with only the basic correction of filter 227. The amplifier in this case is a Gennum GB3210. Filter 227 may comprise, for example, a digital version of the circuit shown in Appendix B.

Figure 4:
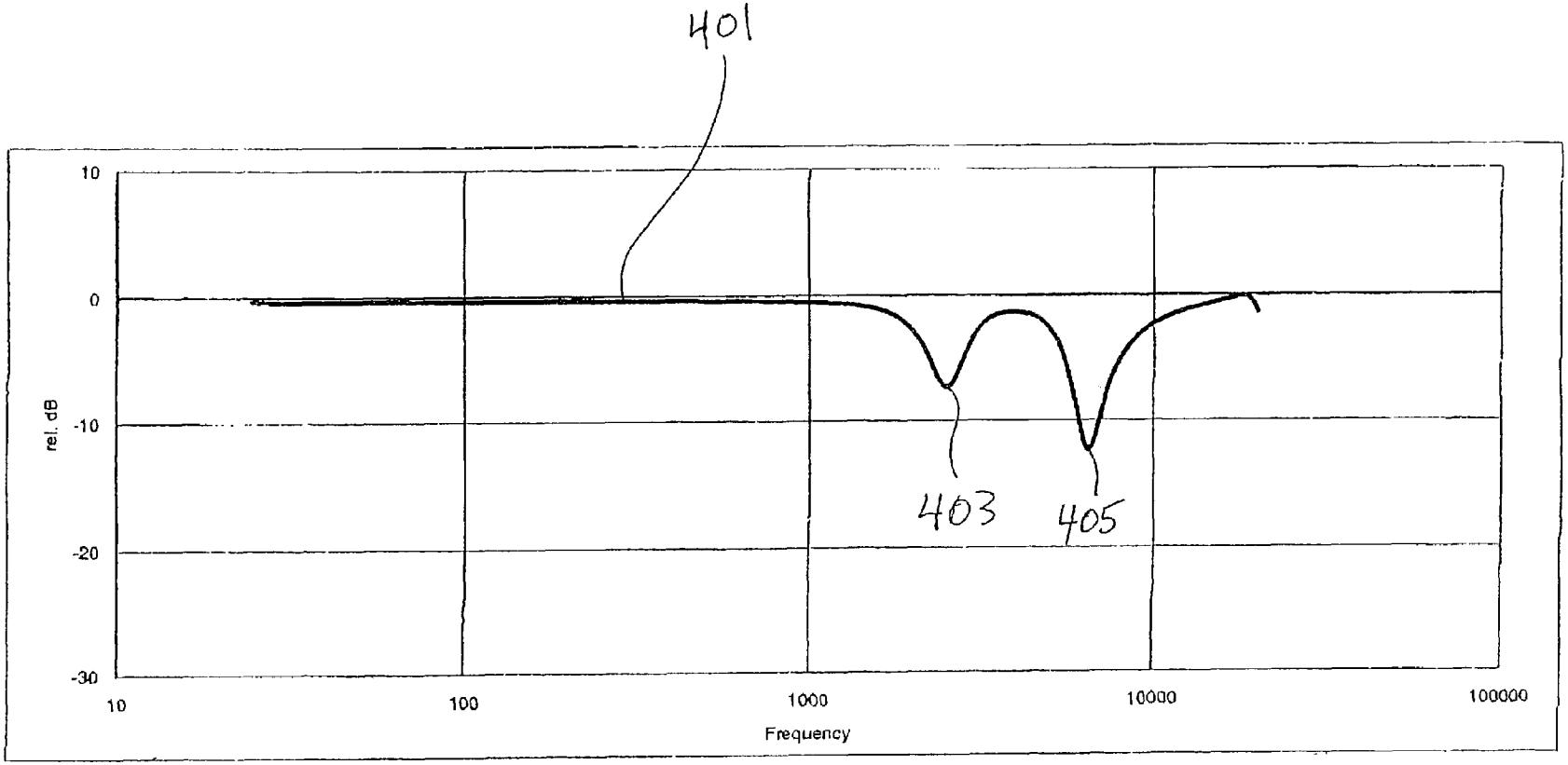
FIG. 4 shows the composite frequency response characteristics of a set of filters adjusted to remove the two peaks in the uncorrected response curve shown in FIG. 3, in accordance with the present invention.

FIG. 4 shows the response characteristics produced by the combination of filters 209 and 211 after they have been adjusted for the undamped peaks in curve 303 of FIG. 3. Curve 401 of FIG. 4 illustrates two notches, namely, notch 403 that results from application of filter 209, and notch 405 that results from application of filter 211. Filters 209 and 211 may comprise, for example, filters as described in incorporated U.S. Pat. No. 5,812,679 and U.S. Pat. No. 6,047,075.

Figure 5:
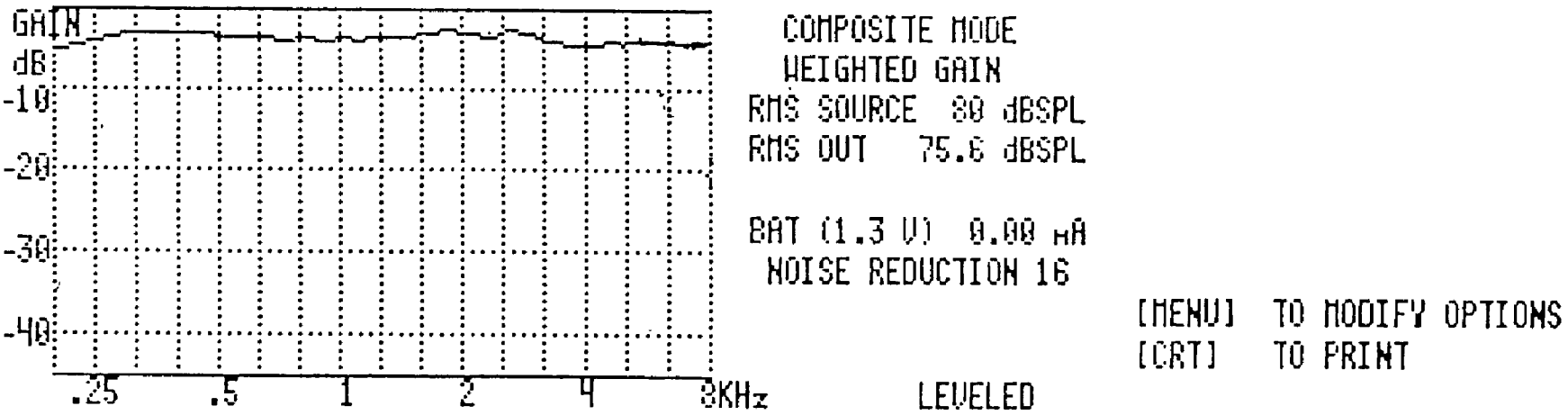
FIG. 5 illustrates the desired flat frequency response resulting from the application of the filters with response characteristics shown in FIG. 4 upon the frequency response characteristics of the undamped hearing aid as shown in FIG. 3, in accordance with the present invention.

FIG. 5 shows the same hearing aid of curve 303 of FIG. 3 after the response has been flattened using filters 209 and 211, as shown in FIG. 4, and filters 203, 205 and 207 have been applied. FIG. 5 illustrates a desired flat response.

Figure 6:
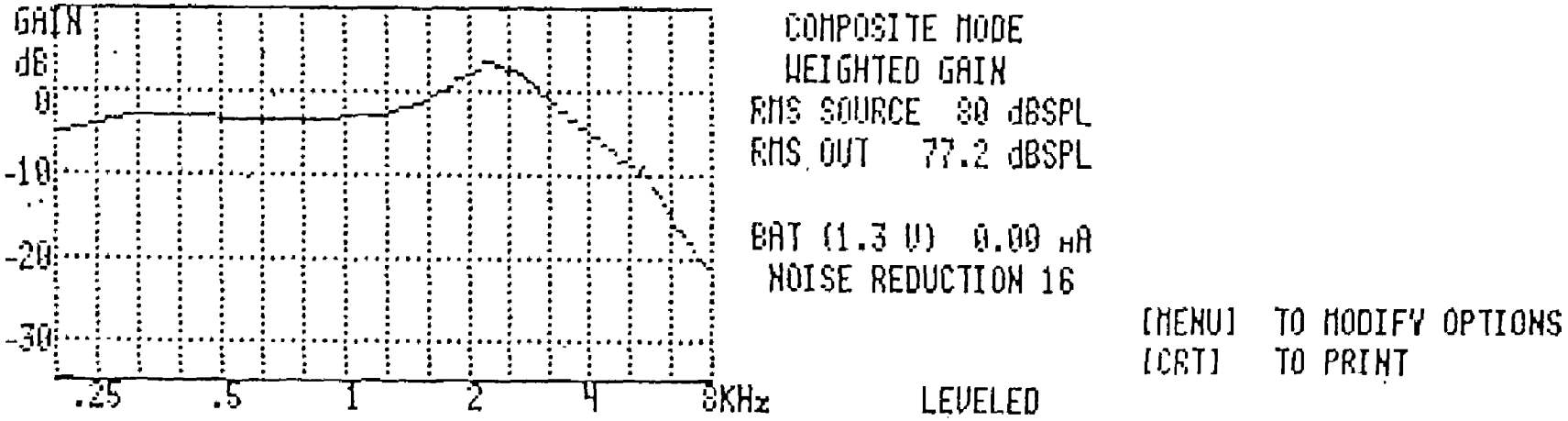
FIG. 6 shows the hearing aid frequency response after the application of a CORFIG response curve to the flat response characteristic shown in FIG. 5, resulting in hearing aid performance in accordance with the present invention.

FIG. 6 shows the same hearing aid of FIG. 5 after filter 225 has been used to reintroduce a "CORFIG" response. FIG. 6 illustrates a frequency response of a hearing aid in accordance with the present invention, such that a listener perceives a high fidelity sound free of the unnatural coloration frequently found in present day digital and analog hearing aids. In other words, the hearing aid produces the response of FIG. 6, but the listener perceives the response of FIG. 5. FIG. 5 thus illustrates the effective frequency response as perceived by the listener, and shows nearly perfect fidelity. To our knowledge, no hearing aid has ever had this high fidelity a frequency response.

Figure 7:
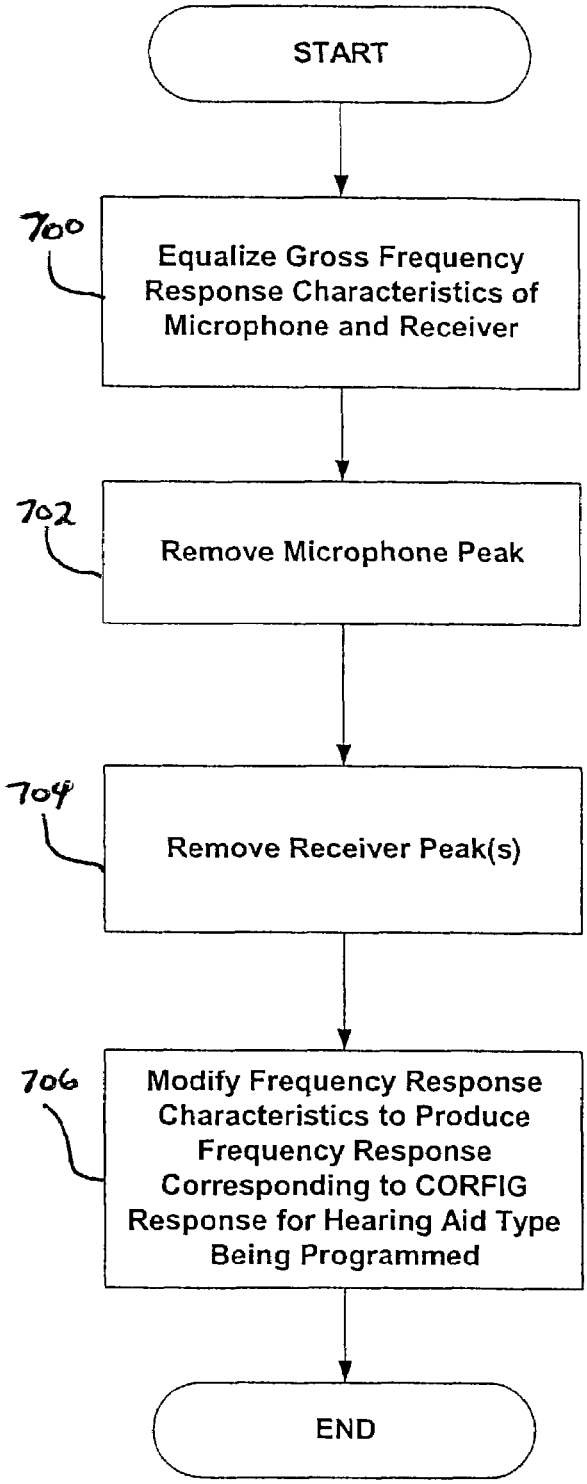
FIG. 7 is a flow diagram illustrating a method of programming a hearing aid in accordance with one embodiment of the present invention.

FIG. 7 is a flow diagram of a method of programming a hearing aid in accordance with one embodiment of the present invention. With this method, at block 700, the hearing aid audio response is modified for gross frequency response characteristics such as the high-frequency roll-off and directionality of the microphone and high-frequency characteristics of the receiver. At the next block, 702, additional compensation is provided to reduce or damp a peak that may be present in the microphone response due to the microphone itself, or the mechanical components coupling the sound energy to the microphone. At block 704, programming is provided to allow peaks in the response curve of the receiver to be minimized. At the last block in the illustrated embodiment, 706, hearing aid performance is modified to apply the CORFIG response curve for the type of hearing aid being programmed. This example of a method of adjusting the operation of the hearing aid results in the perception by the hearing aid user of the high fidelity frequency response shown in FIG. 5.

Figure 8:
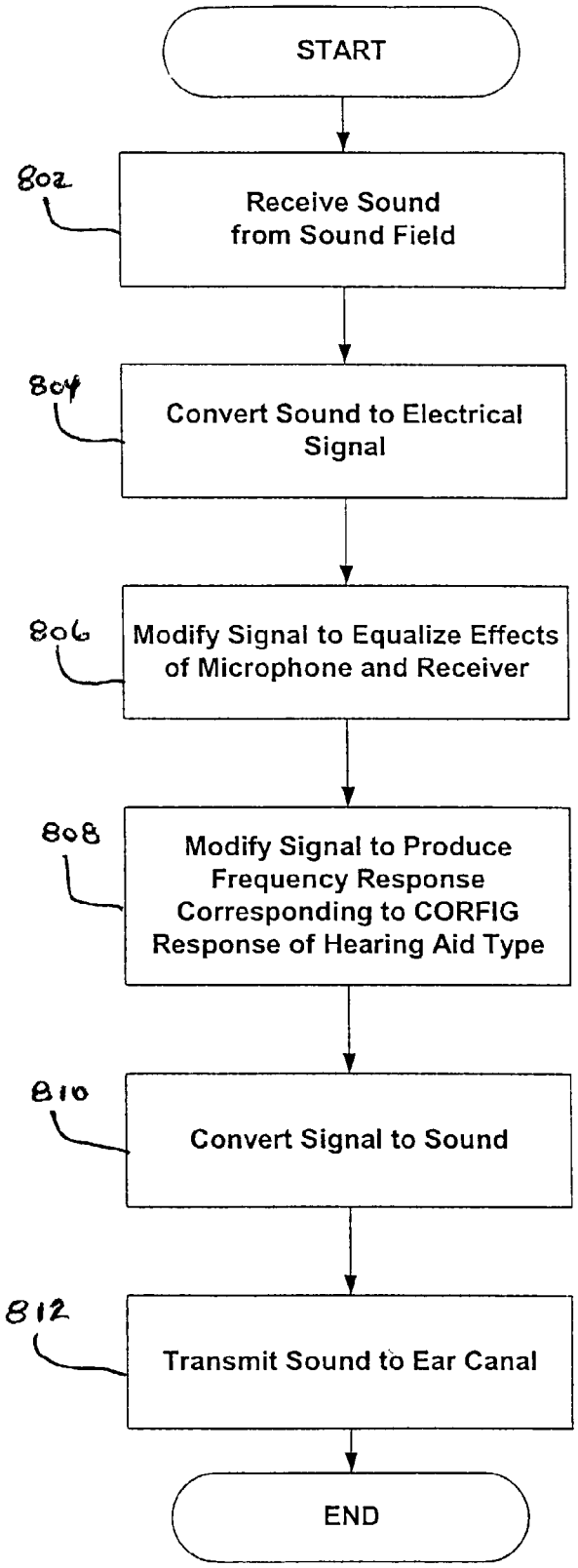
FIG. 8 is a flow diagram showing hearing aid operation for one embodiment of the present invention.

FIG. 8 is a flow diagram illustrating a method of operating a hearing aid in accordance with one embodiment of the present invention. The process begins with block 802, at which sound energy is received from the environment and directed to the microphone of the hearing aid. The microphone converts the sound energy into an electrical signal at block 804. The spectral content of the electrical signal representing the sound is then modified at block 806 to compensate for microphone directionality and for peaks and/or high frequency roll-off in the response curves of the microphone and the receiver. The electrical signal is further modified at block 808 in order to produce a hearing aid response curve that corresponds to the CORFIG response curve for the particular type of hearing aid in operation. At block 810 the receiver of the hearing aid converts the resulting electrical signal back into sound energy, and at block 812 the sound energy is conveyed into the ear canal of the hearing aid user.

While the invention has been described with reference to certain embodiments, it will be understood by those skilled in the art that various changes may be made and equivalents substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed:

1. A digital hearing aid comprising:

a microphone for converting sound into an electrical signal;

at least one pre-filter for flattening a frequency response of the electrical signal;

a plurality of programmable compression amplifiers, wherein each of the plurality of programmable compression amplifiers is programmed to adjust the pre-filtered electrical signal to compensate for frequency-dependent hearing loss of a user;

at least one CORFIG filter for modifying the adjusted electrical signal by inserting a frequency response curve that corresponds to one of a plurality of CORFIG curves for said digital hearing aid, wherein the at least one CORFIG filter is separate from the plurality of programmable compression amplifiers, and the frequency curve inserted by the at least one CORFIG filter is independent of other filtering, including the flattening of the frequency response by the at least one pre-filter; and a receiver for converting said modified electrical signal into sound.

2. The digital hearing aid of claim 1 wherein at least one of said at least one pre-filter and at least one CORFIG filter comprises at least one digital filter.

3. The digital hearing aid of claim 1 further comprising an analog-to-digital converter configured to transform said electrical signal into a digital representation of said electrical signal.

4. The digital hearing aid of claim 1 wherein said at least one pre-filter further comprises a filter configured to provide high frequency boost in order to compensate for the high-frequency roll-off of said microphone.

5. The digital hearing aid of claim 1 wherein said at least one pre-filter further comprises a filter configured to provide low frequency gain boost in order to equalize a directional microphone response to that of a non-directional microphone.

6. The digital hearing aid of claim 1 wherein said at least one pre-filter further comprises a filter configured to remove at least one peak in the frequency response curve of said microphone.

7. The digital hearing aid of claim 1 wherein said at least one pre-filter further comprises a filter configured to remove at least one peak in the frequency response curve of said receiver.

8. The digital hearing aid of claim 1 wherein said at least one pre-filter further comprises a filter configured to provide high-frequency boost in order to compensate for the high frequency roll-off in the frequency response curve of said receiver.

9. The digital hearing aid of claim 1 further comprising:

a bandsplitting filter configured to segment the signal bandwidth contained in said sound into a plurality of sub-bands, producing an output for each of said sub-bands, wherein said output for each of said sub-bands is connected to an input of each of said plurality of programmable compression amplifiers; and a summing means configured to combine an output of each of said programmable compression amplifiers, producing a combined output.

10. The digital hearing aid of claim 1 wherein said at least one CORFIG filter comprises 2 bi-quad filters.

11. The digital hearing aid of claim 1 wherein said at least one pre-filter comprises 5 bi-quad filters.

12. The digital hearing aid of claim 1 wherein said frequency response curve is modified after manufacture of said digital hearing aid.

13. A method of programming a digital hearing aid, said digital hearing aid being of a particular type and having a microphone and a receiver, the method comprising:

equalizing at least one frequency response characteristic of each of said microphone and said receiver;

adjusting said at least one frequency response characteristic of said digital hearing aid to compensate for frequency-dependent hearing loss of an individual hearing aid user after said equalizing step; and modifying said at least one frequency response characteristic of said digital hearing aid, independent of other filtering, by inserting a frequency response curve corresponding to a CORFIG response for said particular type of said digital hearing aid, wherein said modifying by inserting said frequency response curve corresponding to said CORFIG response is after and separate from said adjusting to compensate for frequency-dependent hearing loss of the individual hearing aid user.

14. The method of claim 13 further comprising removing at least one frequency response peak of said microphone.

15. The method of claim 13 further comprising removing at least one frequency response peak of said receiver.

16. A method of operating a digital hearing aid, said digital hearing aid being of a particular type and having a microphone and a receiver, the method comprising:

receiving sound from a sound field;

converting said received sound into an electrical signal;

removing at least one frequency response peak of at least one of said microphone and said receiver;

adjusting said electrical signal to compensate for frequency-dependent hearing loss of a hearing aid user after said at least one frequency peak is removed;

modifying said adjusted electrical signal, independent of other filtering, by inserting a frequency response corresponding to a CORFIG response of said particular type of said digital hearing aid, wherein said modifying by inserting said frequency response corresponding to said CORFIG response is independent of said adjusting to compensate for frequency-dependant hearing loss of the hearing aid user;

converting said modified electrical signal into resulting sound; and transmitting said resulting sound into an ear canal of a hearing aid user.

17. The method of claim 16 wherein said electrical signal is further modified to equalize effects of said microphone and said receiver.

18. A method of operating a digital hearing aid comprising:

receiving sound from a sound field;

generating a desired first frequency response;

modifying said desired first frequency response to compensate for frequency-dependent hearing loss of a hearing aid user; and further modifying said desired first frequency response, independent of other filtering, to achieve a desired second frequency response that is perceived by the hearing aid user to be said desired first frequency response, wherein said further modifying to achieve said second response that is perceived by the hearing aid user to be said desired first frequency response is separate from said modifying to compensate for frequency-dependent hearing loss of the individual hearing aid user.

19. The method of claim 18 wherein said desired first frequency response comprises an approximately flat frequency response.

20. The method of claim 18 wherein said digital hearing aid is of a particular type, and wherein said desired second frequency response comprises a CORFIG response that corresponds to said particular type of said digital hearing aid.

* * * * *